US007322650B2

(12) United States Patent
Chouinard et al.

(10) Patent No.: US 7,322,650 B2
(45) Date of Patent: Jan. 29, 2008

(54) RECLINING CHAIR SYSTEM, METHOD OF OPERATING ASSOCIATED THERETO, AND KIT FOR ASSEMBLING THE SAME

(75) Inventors: Christian Chouinard, St-Rédempteur (CA); Yvan Marcoux, St-Joseph-de Beauce (CA)

(73) Assignee: Crinar Inc., Montréal (Québec) (CA)

( * ) Notice: Subject to any disclaimer, the term of this patent is extended or adjusted under 35 U.S.C. 154(b) by 0 days.

(21) Appl. No.: 11/522,460

(22) Filed: Sep. 18, 2006

(65) Prior Publication Data

US 2007/0063559 A1 Mar. 22, 2007

(51) Int. Cl.
*A47C 3/025* (2006.01)

(52) U.S. Cl. ..... 297/270.2; 297/281; 297/DIG. 7

(58) Field of Classification Search ..... 297/85, 297/270.1, 270.2, 273, 281, 344.21, 344.26, 297/DIG. 7

See application file for complete search history.

(56) References Cited

U.S. PATENT DOCUMENTS 4,212,494 A * 7/1980 Dabney ..... 297/69
4,544,201 A * 10/1985 Rogers, Jr. ..... 297/259.2
4,591,205 A * 5/1986 James ..... 297/85
5,704,686 A * 1/1998 May ..... 297/281
5,795,021 A * 8/1998 Rogers ..... 297/281
5,931,530 A * 8/1999 Liu ..... 297/270.3
6,000,754 A * 12/1999 Lawson ..... 297/259.2
6,588,841 B1 * 7/2003 Hoffman et al. ..... 297/270.3
6,913,317 B2 * 7/2005 Vanderminden et al. ..... 297/344.24
7,040,692 B1 * 5/2006 Pine ..... 297/85

* cited by examiner

*Primary Examiner*—Peter R. Brown
(74) *Attorney, Agent, or Firm*—ROBIC

(57) ABSTRACT

A reclining chair system operable about different modes. The reclining chair includes a base, an intermediate member, left and right side frames, a support chassis, and a footrest. The intermediate member has opposite left and right sides, and is mounted onto the base so as to be rotatably moveable with respect to the base via a corresponding rotating assembly so as to operate the reclining chair in a rotating mode. The left and right side frames are operatively mounted respectively onto the left and right sides of the intermediate member via a corresponding rocking assembly so as to operate the reclining chair system in a rocking mode. The support chassis extends between the left and right side frames for operatively supporting a seat and a backrest of the reclining chair system. The footrest is operatively mounted onto the support chassis and is operable therealong between retracted and extended positions via a corresponding deployment assembly so as to operate the reclining chair system in a deployed mode, the footrest being further configured to be operated into an elevated position whereby the deployment assembly of the footrest cooperates with the rocking assembly of the intermediate member so as to prevent the reclining chair system from being operated in the rocking mode. Also described are a method of operating the reclining chair system, and a kit for assembling the same.

19 Claims, 16 Drawing Sheets

RECLINING CHAIR SYSTEM, METHOD OF OPERATING ASSOCIATED THERETO, AND KIT FOR ASSEMBLING THE SAME

FIELD OF THE INVENTION

The present invention relates to a chair system. More particularly, in its preferred intended use, the present invention relates to a reclining chair system that is operable about different modes and configurations, and that comprises an integrated extensible footrest. The present invention also relates to a method of operating said chair system, and to a kit for assembling the same. The present application claims priority of U.S. provisional patent application No. 60/717,237 dated Sep. 16, 2005, the content of which is incorporated herein by reference.

BACKGROUND OF THE INVENTION

Is it well known in the art that there exists different types of rocking and reclining easy chairs on the market, and that these conventional chairs present drawbacks and inconveniences, particularly when compared with the components, features and functions of the present invention, as will be explained in greater detail hereinbelow.

Indeed, the ones offering similar functions use a completely different rocking and extensible footrest mechanism. The motion and the length of the glide is much shorter, the position of the backrest and seat when reclined is not the same angle, and the extensible footrest is not deployed in the same manner. The concept and the components used are different. With this type of mechanism, typically sold by Legget™ and Platt™, a shorter rocker arm is used, and the distance between the rocker arms is shorter as well. When the chair is in the reclined position, the rocking action is halted differently. The swivel/gliding/extensible footrest mechanism assembly has no resemblance to that of the present invention, as will also be explained hereinbelow.

It is also known in the art that a conventional reclining chair typically has two manual hand levers situated on each side of the easy chair. One hand lever is used to deploy the extensible footrest, and the other lever is employed to stop the rocking action. Also, the inclination of the seat and backrest are generally independent of the other functions.

It is also known in the art that for another type of fully upholstered recliners with footrests, like La-Z-Boy™ brand, Berkline™ brand, etc., the brackets for the footrest and the components used for the rocking action are very different from the smooth, long gliding action found on a rocker recliner with ball bearing arms.

None of the conventional easy chairs known in the art combine the long smooth gliding action found with bearing arms, or an extensible footrest which deploys from simply pushing back on the backrest, with no hand lever mechanism being necessary.

Hence, in light of the aforementioned, there is a need for such an improved reclining chair system which would be able to overcome and/or remedy some of the above-discussed prior art problems.

SUMMARY OF THE INVENTION

An object of the present invention is to provide a reclining chair system which, by virtue of its design and components, satisfies some of the above-mentioned needs and which is thus an improvement over other related chair systems and/or methods of operating chair systems known in the prior art.

In accordance with the present invention, the above object is achieved, as will be easily understood from the present description, with a reclining chair system operable about different modes, the reclining chair system comprising:

a base;

an intermediate member comprising opposite left and right sides, the intermediate member being mounted onto the base and being rotatably moveable with respect to the same via a corresponding rotating assembly so as to operate the reclining chair system in a rotating mode;

left and right side frames being operatively mounted respectively onto the left and right sides of the intermediate member via a corresponding rocking assembly so as to operate the reclining chair system in a rocking mode;

a support chassis extending between the left and right side frames for operatively supporting a seat and a backrest of the reclining chair system; and a footrest operatively mounted onto the support chassis and operable therealong between retracted and extended positions via a corresponding deployment assembly so as to operate the reclining chair system in a deployed mode, the footrest being further configured to be operated into an elevated position whereby the deployment assembly of the footrest cooperates with the rocking assembly of the intermediate member so as to prevent the reclining chair system from being operated in the rocking mode.

Preferably, the rotating assembly comprises a socket provided on the base and a rod provided on the intermediate member, the rod of the intermediate member being insertable into the socket of the base and being rotatable thereabout.

Preferably also, the base comprises a circular ring for resting against a floor surface, and a plurality of support bars extending between the circular ring and the socket, the socket being elevated with respect to the circular ring.

Preferably also, the socket of the base is provided with a bearing for receiving the rod of the intermediate member and for facilitating rotation of said rod with respect to the socket of the base.

Preferably also, the intermediate member comprises a pair of front and rear horns operatively connected to the base and projecting therefrom, the front horn having extremities defining front connection points and the rear horn having extremities defining rear connection points, a pair of front and rear connection points being disposed respectively on each of the left and right sides of the intermediate member.

Preferably also, each of the left and right side frames comprises front and rear connection points, and the rocking assembly comprises a pair of front and rear bearing arms, the front bearing arms operatively connecting the front connection points of the front horn of the intermediate member to the front connection points of the side frames, and the rear bearing arms operatively connecting the rear connection points of the rear horn of the intermediate member to the rear connection points of the side frames, so that the left and right side frames are capable of rocking with respect to the intermediate member, and thus with respect to the base supporting the same.

Preferably also, the bearing arms each comprise a pair of bearing plates and a crossbar extending between said pair of bearing plates, each bearing plate having opposite ends pivotably mounted onto corresponding connection points of a side frame and horn respectively.

Preferably also, the connection points of the horns and of the side frames are provided with pins for receiving corresponding ends of corresponding bearing plates.

Preferably also, the deployment assembly comprises a pair of left and right deployment mechanisms, each deployment mechanism comprising:

a mounting bracket securely mounted onto the support chassis extending between the left and right side frames, the mounting bracket being positioned on a given side of the support chassis and said given side being adjacent to a given side frame; and a support bracket for supporting a portion of the seat and backrest being securely mounted onto said support bracket, the support bracket being operatively connected to the mounting bracket by means of corresponding links, and being displaceable rearwardly with respect to said mounting bracket between a leveled position and a first tilted position, so as to operate the reclining chair system into a first tilted mode.

Preferably also, each deployment mechanism further comprises an extendable truss mechanism having opposite first and second ends, the first end being provided with the footrest, and the second end being operatively connected to the mounting and support brackets, the extendable truss mechanism being further configured for cooperation with the mounting and support brackets so that the footrest be operable between the retracted and extended positions as a result of the support bracket being displaced rearwardly with respect to the mounting bracket, into the first tilted position.

According to a preferred embodiment of the present invention, the corresponding links comprise:

a tilting bar having opposite first and second ends, the first end being pivotably mounted about a rear portion of the mounting bracket and the second end being pivotably mounted about a rear portion of the support bracket for tilting the support bracket rearwardly with respect to the base bracket when the tilting bar is displaced readwardly;

a base bar pivotably mounted about the mounting bracket and having opposites first and second ends;

a rocker bar having first and second ends, the first end being pivotably mounted onto a front portion of the mounting bracket, and the second end being provided with a slot; and a substantially V-shaped pivot bar having first and second ends, and a mid end, the first end being pivotably mounted onto the support bracket, the mid end being pivotably mounted about the first end of the base bar, and the second end comprising a pin being slidably moveable along the slot of the second end of the rocker bar;

wherein the extendable truss mechanism comprises a plurality of intercrossed bars, a first bar of said intercrossed bars having an end pivotably mounted onto a front portion of the support bracket, and a second bar of said intercrossed bars having an end pivotably mounted onto the second end of the substantially V-shaped pivot bar, the bars of the corresponding links and the bars of the extendable truss mechanism being positioned, shaped and sized with respect to one another, and with respect to the mounting and support brackets so that a rearwardly displacement of the support bracket with respect to the mounting bracket in turns drives the footrest into the extended position, thereby operating the reclining chair system in the deployed mode, and wherein a further rearwardly displacement of the support bracket with respect to the mounting bracket in turns drives the footrest into the elevated position.

Preferably also, each deployment mechanism comprises a spring operatively connected between a given bar of the intercrossed bars of the extendable truss mechanism and the support bracket, for facilitating a return of the footrest into the retracted position.

Preferably also, the support bracket further comprises a hooking assembly being positioned, shaped and sized for hooking onto a corresponding stopper provided adjacent to a corresponding extremity of the rear horn, when the footrest is driven into the elevated position, for preventing the support chassis and corresponding components operatively mounted thereon from being rocked with respect to the intermediate member, and thus with respect to the base supporting the same, so as to operate the reclining chair system into a second tilted mode where the reclining chair system is prevented from being operated in the rocking mode.

Preferably also, the hooking assembly comprises:

a support flange extending downwardly from the support bracket; and a hooking member pivotably mounted about the support flange, and having opposite front and rear ends, the rear end of the hooking member having a slanted portion for slanting past the stopper, and a hooking portion frontwardly opposite to said slanting portion for hooking the stopper once the slanting portion has passed over said stopper, and the front end of the hooking member being provided with a spring connected to the support bracket for biasing the front end of the hooking member upwardly towards said support bracket.

Preferably also, the hooking assembly comprises an adjusting device for selectively adjusting a minimum default angle of slant for the hooking member.

Preferably also, the adjusting device comprises a screw threadedly engaged into a corresponding orifice of a rim of the front end of the hooking member and having an extremity in abutment with an angled portion of the support flange, the minimum default angle of slant for the hooking member being selectively adjustable by selectively rotating the screw about the corresponding orifice and against the angled portion of the support flange.

Preferably also, the support bracket is substantially L-shaped, the support flange is substantially Y-shaped, and the side frames are substantially inverted U-shaped.

Preferably also, the side frames are each provided with corresponding arm rests.

Preferably also, exposed outer components thereof are upholstered.

According to yet another aspect of the invention, there is also provided a method of operating the above-mentioned reclining chair system.

According to yet another aspect of the invention, there is also provided a kit for assembling the above-mentioned reclining chair system.

The objects, advantages, and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
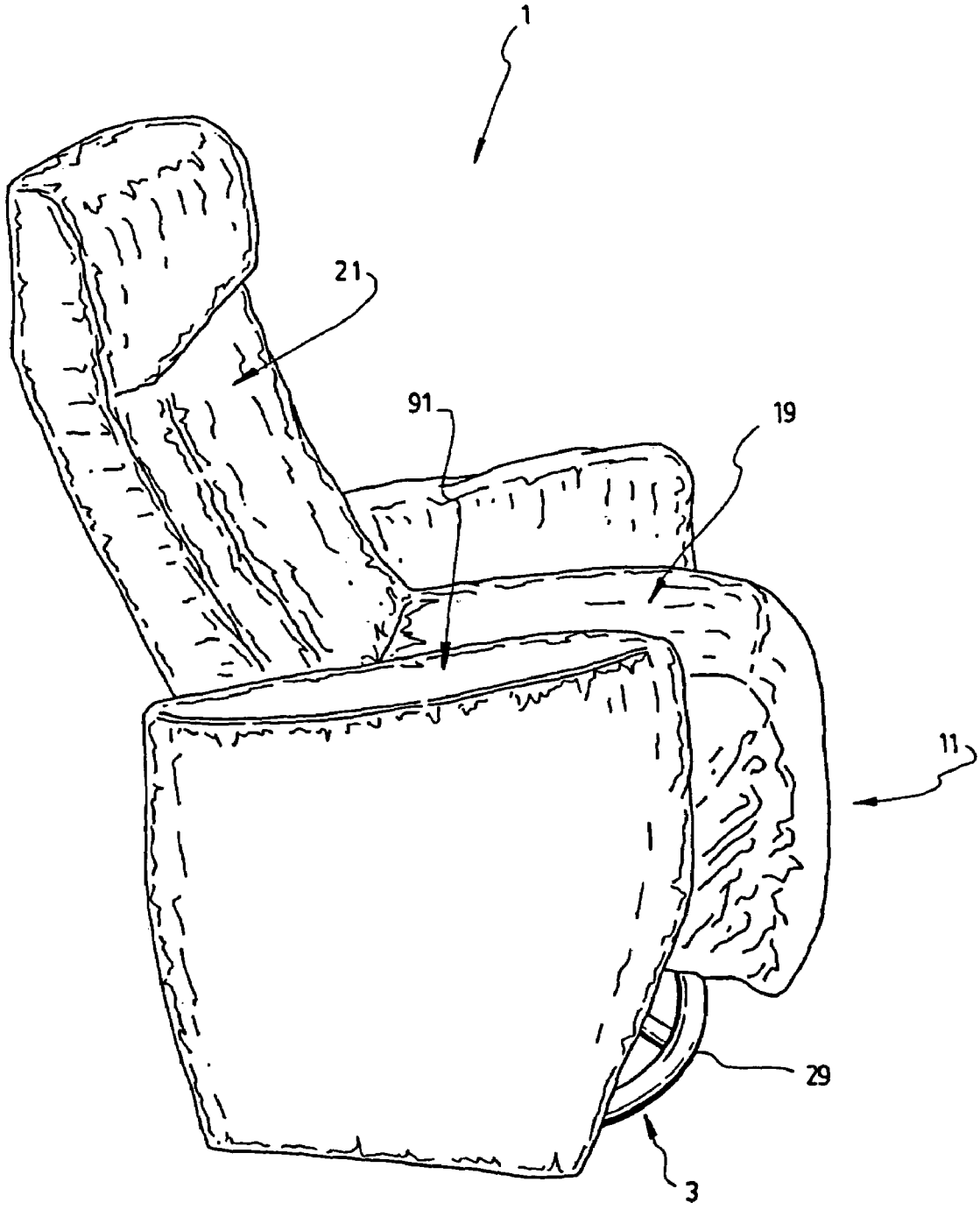
FIG. 1 is a side perspective view of a reclining chair system provided with upholstery according to a preferred embodiment of the present invention.

In the following description, the same numerical references refer to similar elements. The embodiments shown in the figures are preferred, for exemplification purposes only.

Moreover, although the present invention was primarily designed for use with a reclining chair system, it may be used with other objects and/or other types of fields, such as for example, passenger seats, medical equipment for treating patients, etc., as apparent to a person skilled in the art. For this reason, expressions such as "reclining", "chair", "system", etc., used herein should not be taken so as to limit the scope of the present invention and include all other kinds of objects and/or applications with which the present invention could be used and may be useful.

Moreover, in the context of the present invention, the expressions "chair", "recliner", "rocker", "sofa", "device", "product", "system", as well as any other equivalent expressions and/or compound words thereof, may be used interchangeably. The same applies for any other mutually equivalent expressions, such as "reclining" and "rocking" for example, as well as "brackets" and "tubes", as well as "swiveling" and "rotation", as well as "rocking ", "oscillating" and "gliding", as well as "about", "along" and "into", as well as "configuration", "position" and "mode", as well as "connected" and "mounted", as well as "in" and "into", as well as "displaceable", "moveable" and "tiltable", as well as "horn" and "U-shaped member", as also apparent to a person skilled in the art.

In addition, although the preferred embodiments of the present invention as illustrated in the accompanying drawings comprise various components, and although the preferred embodiments of the reclining chair system 1 and corresponding parts as shown consist of certain geometrical configurations as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperations thereinbetween, as well as other suitable geometrical configurations may be used for the reclining chair system 1 and corresponding parts according to the present invention, as will be briefly explained herein and as can be easily inferred herefrom by a person skilled in the art, without departing from the scope of the present invention.

Broadly described, the reclining chair system 1 according to the present invention, relates to a reclining chair system 1 such as the ones found in the furniture industry, in particular to the sector of reclining, swivel and/or gliding easy chairs, preferably with ball bearings, made with either metal, wood base and/or the like, and fully upholstered recliners, with integrated extensible footrest like La-Z-Boy™, Berkline™, etc., as will be easily understood from the present description by a person skilled in the art. Preferably also, the present system comprises a reclining metal base and an upholstered easy chair which glides and swivels on metal ball bearings, and also has an integrated extensible footrest 11, as can be easily understood from the accompanying drawings.

Indeed, according to the present invention, there is provided a reclining chair system 1 operable about different modes. As better shown in FIGS. 1-5, the reclining chair system 1 comprises a base 3, an intermediate member 5, left and right side frames 7*l*,7*r*, a support chassis 9, and an extensible integrated footrest 11. The intermediate member 5 comprises opposite left and right sides 13*l*,13*r*, and is preferably mounted onto the base 1 and rotatably moveable with respect to the same via a corresponding rotating assembly 15 so as to operate the reclining chair system 1 in a rotating mode, as can be easily understood when referring to FIGS. 2-5. The left and right side frames 7*l*,7*r* are operatively mounted respectively onto the left and right sides 13*l*,13*r* of the intermediate member 5 via a corresponding rocking assembly 17 so as to operate the reclining chair system 1 in a rocking mode, as can be easily understood when contrasting FIGS. 2 and 3. The support chassis 9 extends between the left and right side frames 7*l*,7*r* for operatively supporting, namely, a seat 19 and a backrest 21 of the reclining chair system 1, as shown in FIGS. 2-5. The footrest 11 is operatively mounted onto the support chassis 9 and is operable therealong between retracted and extended positions via a corresponding deployment assembly 23 so as to operate the reclining chair system 1 in a deployed mode, the footrest 11 being further configured to be operated into an elevated position whereby the deployment assembly 23 of the footrest 11 cooperates with the rocking assembly 17 of the intermediate member 5 so as to prevent the reclining chair system 1 from being operated in the rocking mode, as will be explained in greater detail hereinbelow, particularly when referring to FIGS. 6-16.

Preferably, and as can be easily understood from FIGS. 2-5, the rotating assembly 17 comprises a socket 25 provided on the base 3 and a rod 27 provided on the intermediate member 5, the rod 27 of the intermediate member 5 being insertable into the socket 25 of the base 3 and being rotatable thereabout. Preferably also, the base 3 comprises a circular ring 29 for resting against a floor surface, and a plurality of support bars 31 extending between the circular ring 29 and the socket 25, the socket 25 being elevated with respect to the circular ring 29. Preferably also, the socket 25 of the base 3 is provided with a bearing 33 for receiving the rod 27 of the intermediate member 5 and for facilitating rotation of said rod 27 with respect to the socket 25 of the base 3.

It is worth mentioning however that according to the present invention, the rod 27 and socket 23 combination are mere examples of a possible embodiment for the rotating assembly 15, and that several other different types of rotating assemblies 15 enabling a rotation of the intermediate member 5 with respect to the base 3 could be used for the reclining chair system 1 according to the present invention, without departing from the scope thereof, as can be easily understood by a person skilled in the art.

Figure 3:
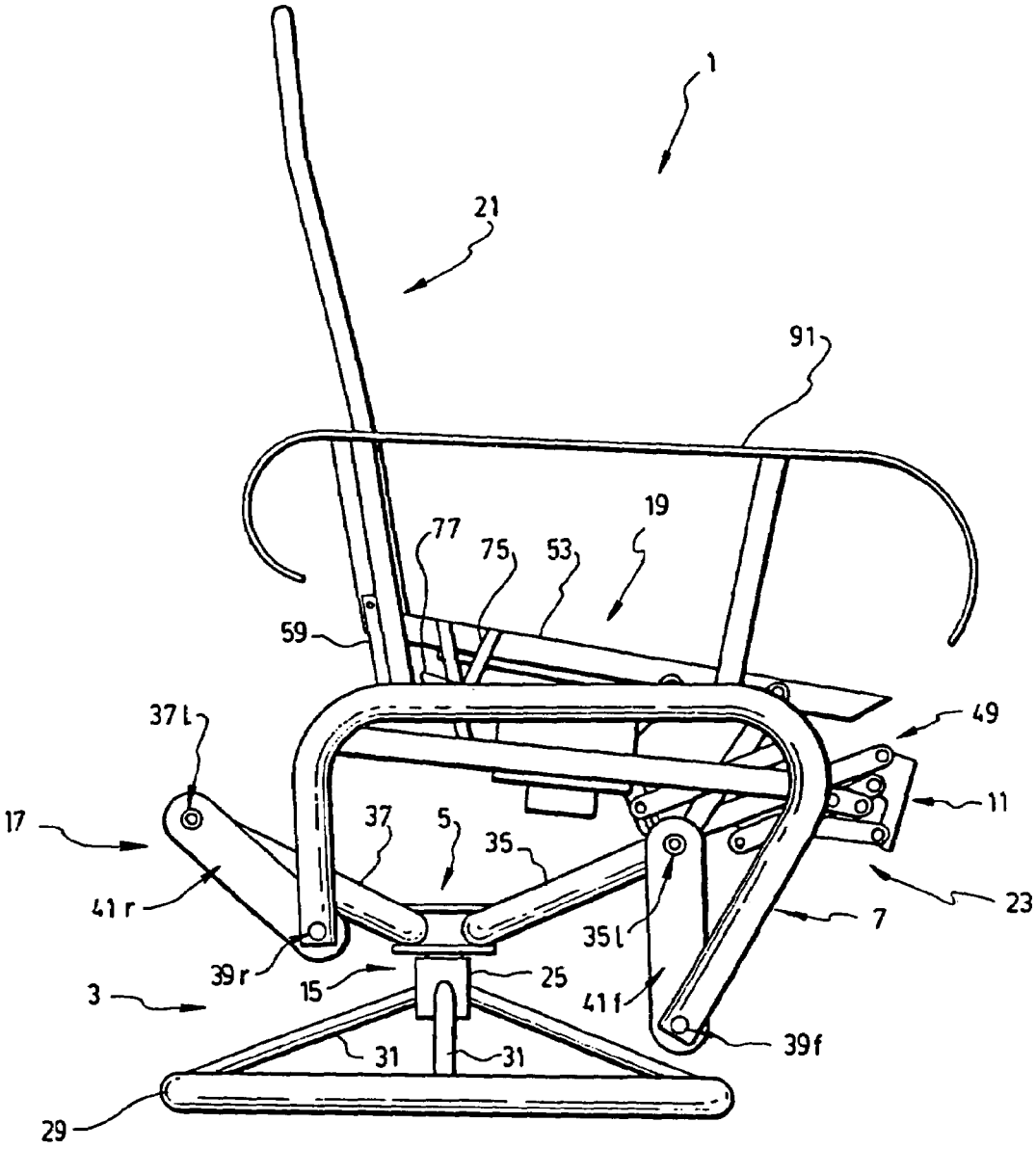
FIG. 3 is another side view of what is shown in FIG. 2, the reclining chair system being now shown in another configuration within a rocking mode.
Figure 4:
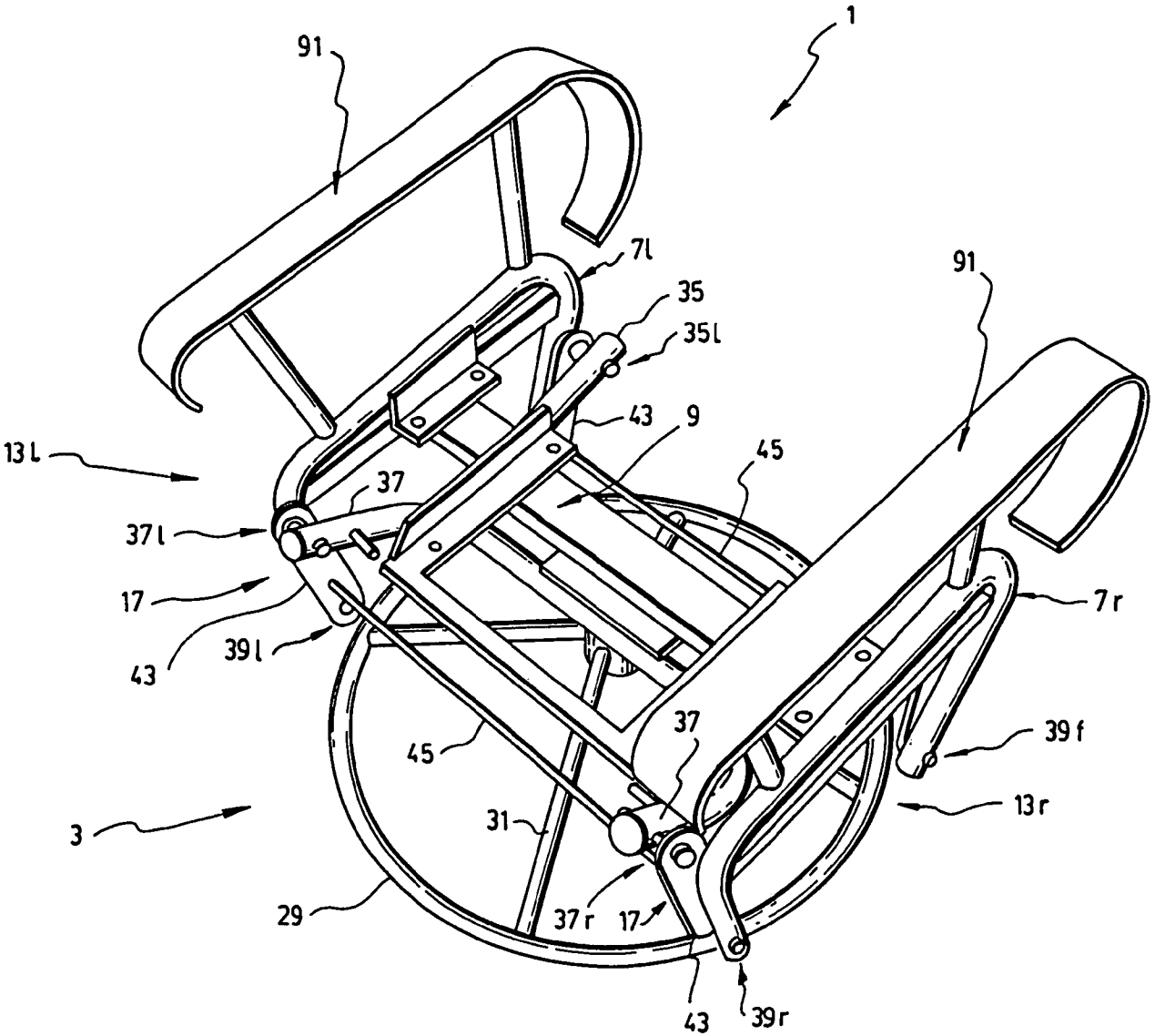
FIG. 4 is a top perspective view of what is shown in FIG. 2, the reclining chair system being now shown without a backrest and without deployment mechanisms.
Figure 5:
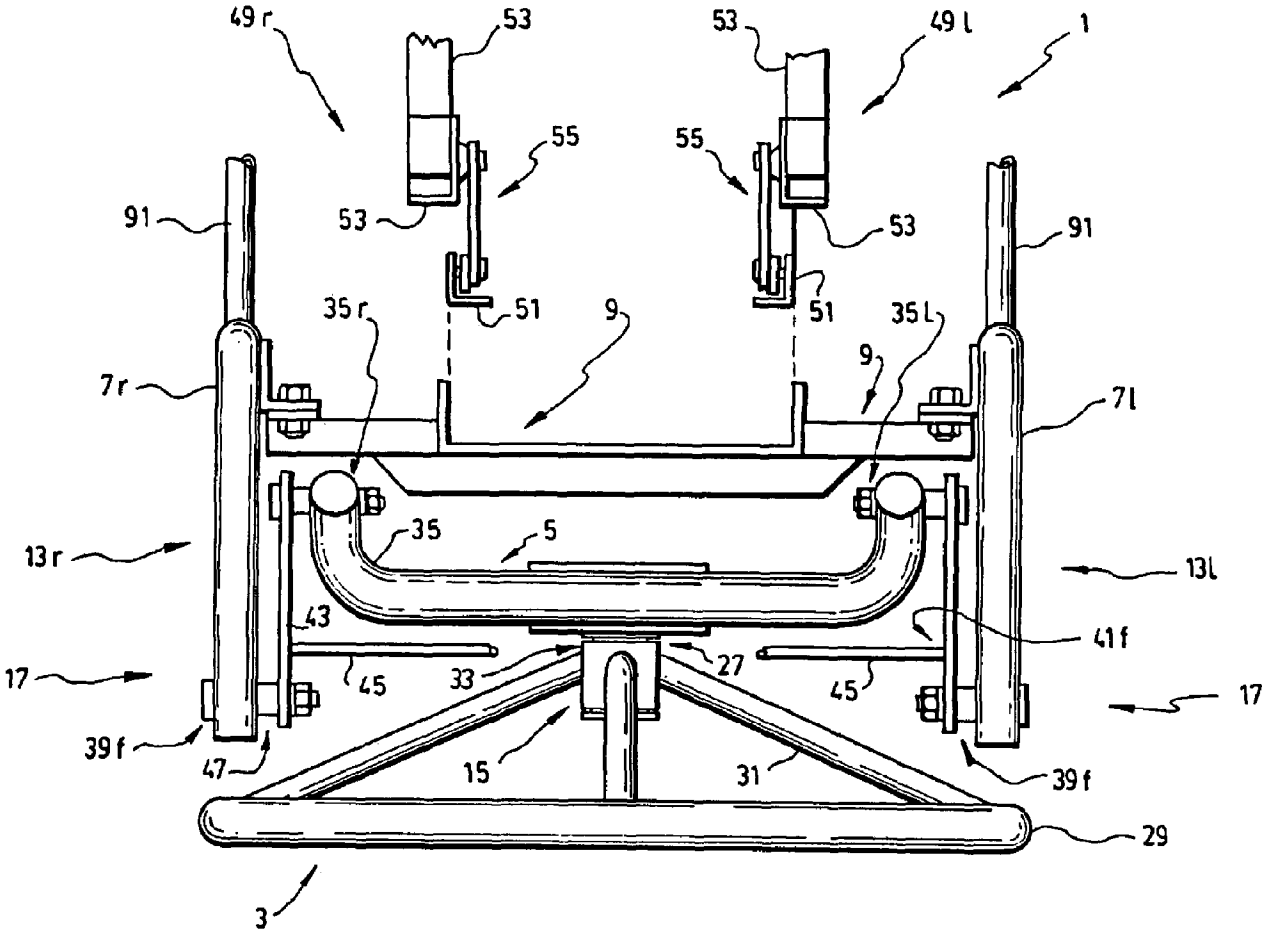
FIG. 5 is a partial front view of what is shown in FIG. 4, the support chassis being now shown in an exploded relationship with a partial view of left and right deployment mechanisms to be mounted thereon.

Preferably also, and as can be easily understood when referring to FIGS. 2-5, and more particularly FIG. 5, the intermediate member 5 comprises a pair of front and rear horns 35,37 operatively connected to the base 5 and projecting therefrom, the front horn 35 having extremities defining front connection points 35*l*,35*r*, and the rear horn 37 having extremities defining rear connection points 37*l*, 37*r*, a pair of front and rear connection points 35,37 being disposed respectively on each of the left and right sides 13*l*,13*r* of the intermediate member 5.

Figure 2:
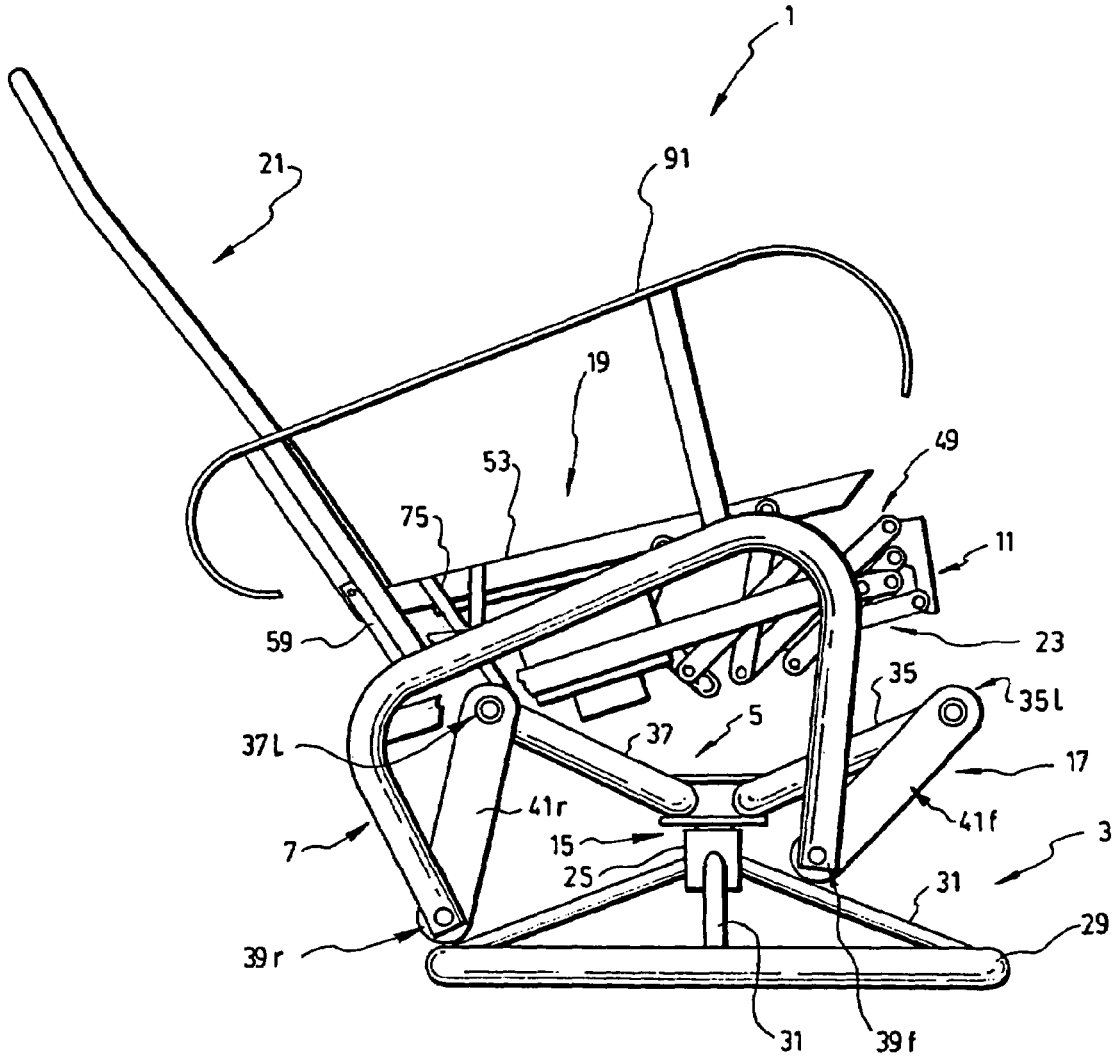
FIG. 2 is a side view of what is shown in FIG. 1, the reclining chair system being now shown deprived of upholstery so as to better illustrate the inner components thereof, the reclining chair system being shown in a first configuration within a rocking mode.

Preferably also, and as better shown in FIGS. 2 and 3, each of the left and right side frames 7*l*,7*r* comprises front and rear connection points 39*f*,39*r*, and the rocking assembly 17 preferably comprises a pair of front and rear bearing arms 41*f*,41*r*, the front bearing 41*f* arms operatively connecting the front connection points 35*l*,35*r* of the front horn 35 of the intermediate member 5 to the front connection points 39*f* of the side frames 7, and the rear bearing arms 41*r* operatively connecting the rear connection points 37*l*,37*r* of the rear horn 37 of the intermediate member 5 to the rear connection points 39*r* of the side frames 7, so that the left and right side frames 7*l*,7*r* are capable of rocking with respect to the intermediate member 5, and thus with respect to the base 3 supporting the same.

Preferably also, and as better shown in FIGS. 4 and 5, the bearing arms 41 each comprise a pair of bearing plates 43 and a crossbar 45 extending between said pair of bearing plates 43, each bearing plate 43 having opposite ends pivotably mounted onto corresponding connection points of a side frame 7*l*,7*r* and horn 35,37 respectively.

As better shown in FIG. 5, the connection points 35*l*,35*r*, 37*l*,37*r* of the horns 35,37 and of the side frames 7*l*,7*r* are provided with pins 47 for receiving corresponding ends of corresponding bearing plates 43, and may additionally be provided with other corresponding fasteners and/or components (e.g. bolts, spacers, washers, nuts, etc.), for ensuring a proper operation and distance between corresponding components of the reclining chair system 1, as can be easily understood by a person skilled in the art.

As better shown in FIGS. 2, 3 and 5, the deployment assembly preferably comprises a pair of left and right deployment mechanisms 49*l*,49*r*. Referring more particularly now to FIGS. 5-16, each deployment mechanism 49 preferably comprises a mounting bracket 51 securely mounted onto the support chassis 9 extending between the left and right side frames 7*l*,7*r*, the mounting bracket 51 being positioned on a given side of the support chassis 9 and said given side being adjacent to a given side frame 7*l*,7*r*. According to the preferred embodiment of the deployment mechanism 49, and as can be easily understood when referring to FIGS. 2, 3 and 6, the deployment mechanism 49 also preferably comprises a support bracket 53 for supporting namely, among other components, a portion of the seat 19 and backrest 21 being securely mounted onto said support bracket 53, the support bracket 53 being operatively connected to the mounting bracket 51 by means of corresponding links 55, and being displaceable rearwardly with respect to said mounting bracket 51 between a leveled position and a first tilted position, so as to operate the reclining chair system 1 into a first tilted mode, as can be easily understood when referring to FIGS. 6-14.

Preferably also, and as can be easily understood from the above-mentioned FIGS. 6-14, each deployment mechanism 49 further comprises an extendable truss mechanism 57 having opposite first and second ends, the first end being provided with the footrest 11, and the second end being operatively connected to the mounting and support brackets 51,53, the extendable truss mechanism 57 being further configured for cooperation with the mounting and support brackets 51,53 so that the footrest 11 be operable between the retracted and extended positions as a result of the support bracket 53 being displaced rearwardly with respect to the mounting bracket 51, into the first tilted position.

Figure 6:
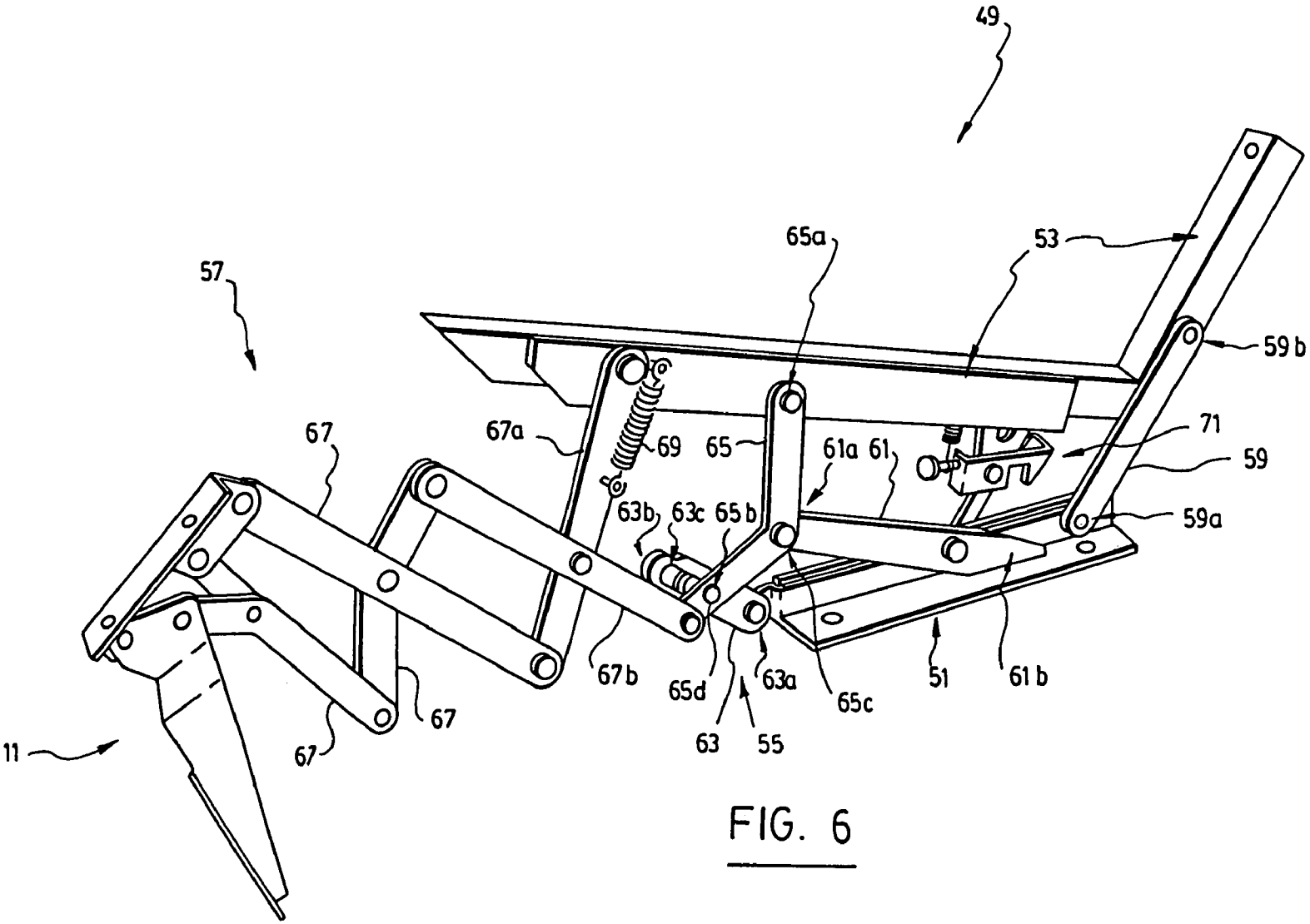
FIG. 6 is a perspective view of a deployment mechanism according to a preferred embodiment of the present invention, the deployment mechanism being shown in an intermediate configuration.
Figure 7:
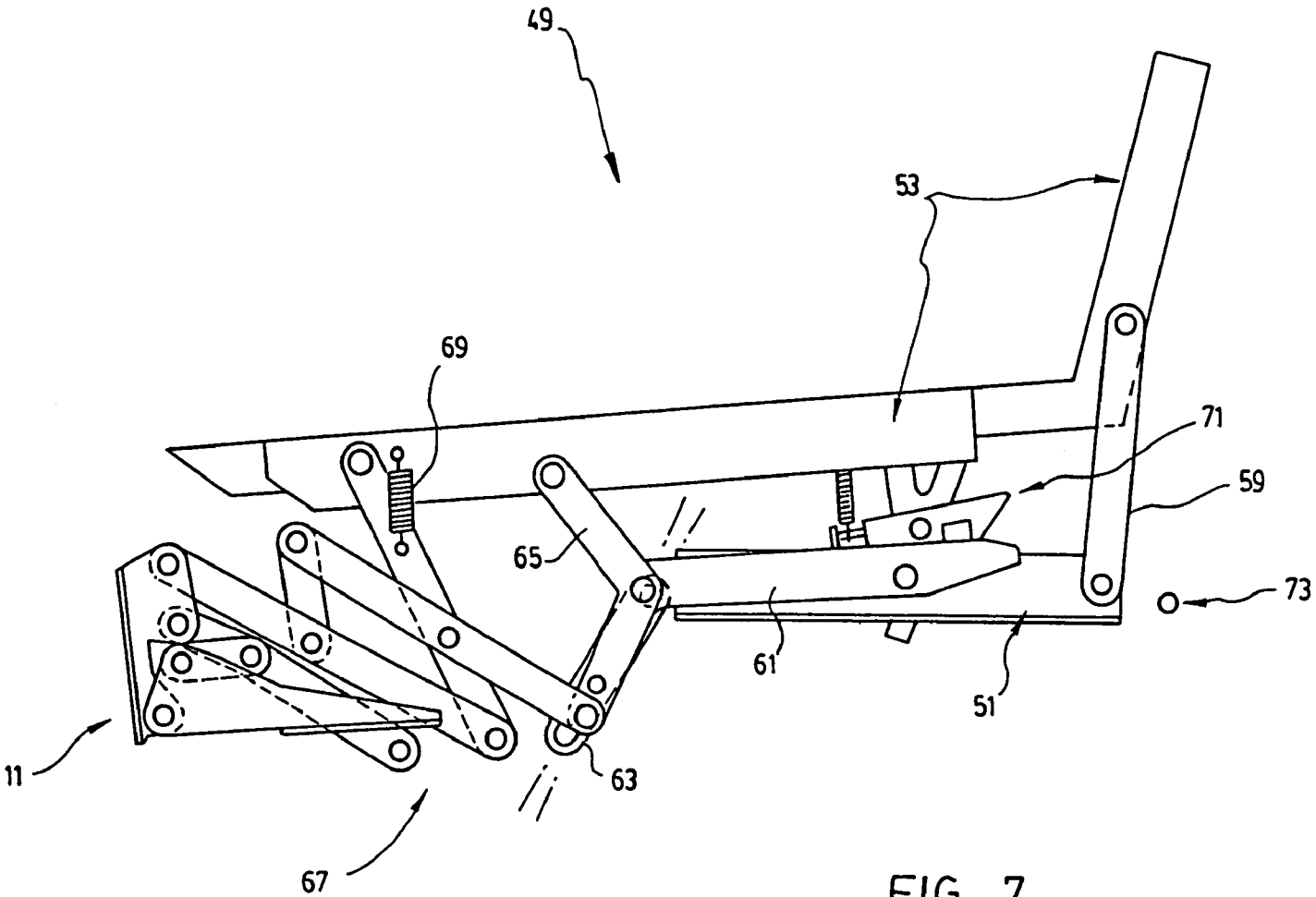
FIG. 7 is a side view of the deployment mechanism shown in FIG. 6, the deployment mechanism being now shown in a retracted configuration, and adjacent to a corresponding stopper of the system according to a preferred embodiment of the present invention.
Figure 8:
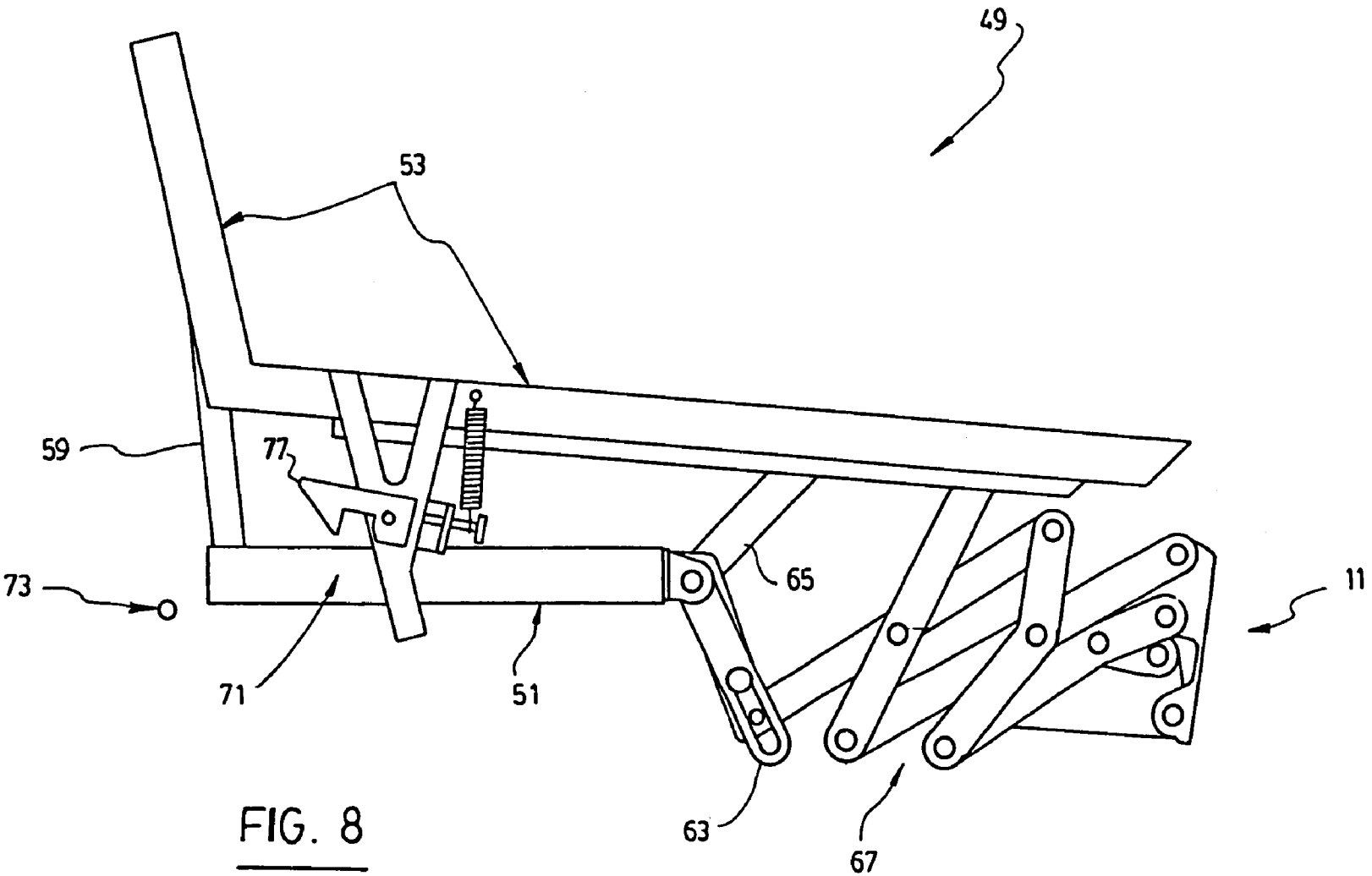
FIG. 8 is a side view of the reverse side of what is shown in FIG. 7.
Figure 9:
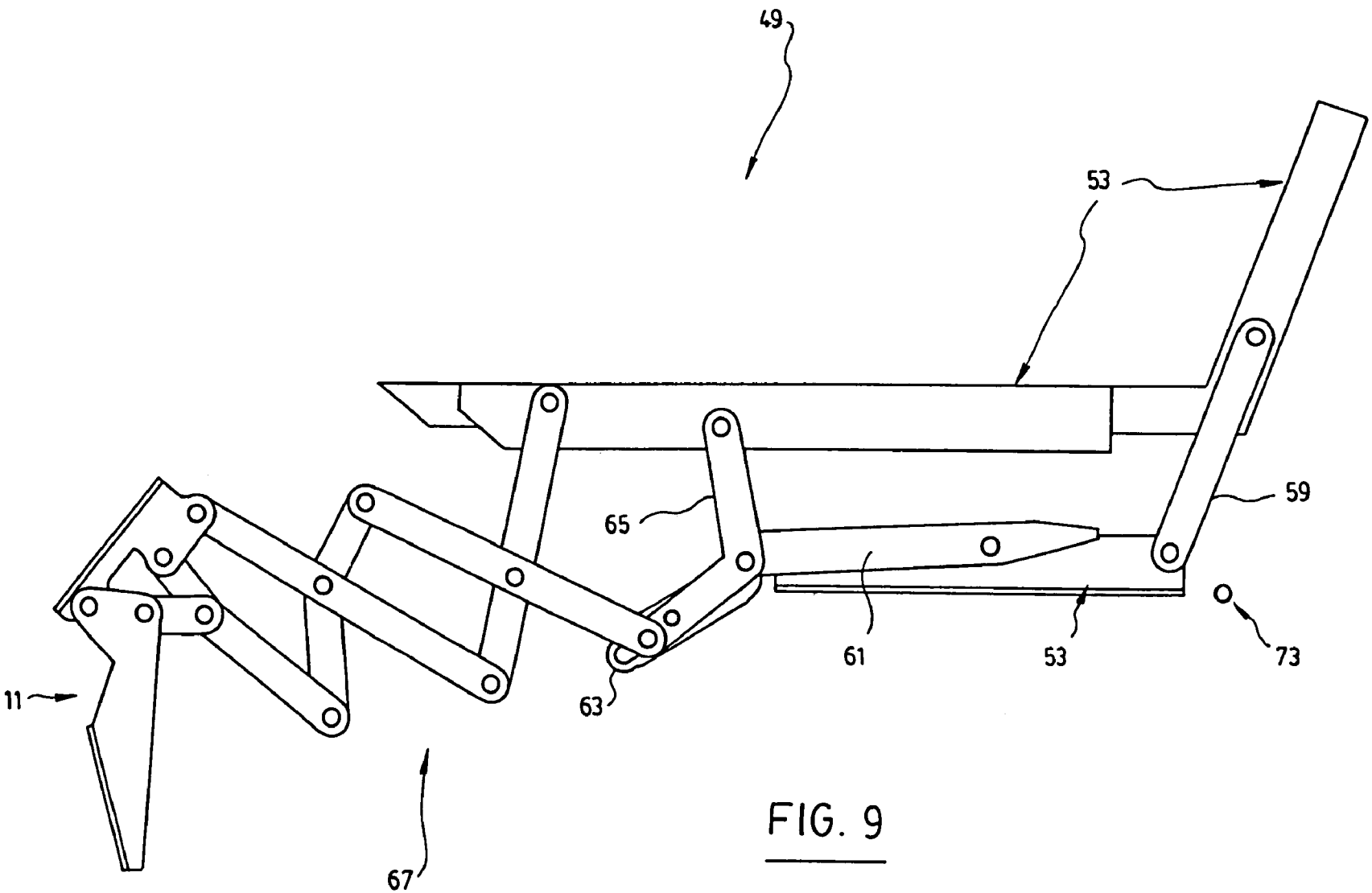
FIG. 9 is another side view of what is shown in FIG. 7, the deployment mechanism being now shown in an intermediate extended configuration.
Figure 10:
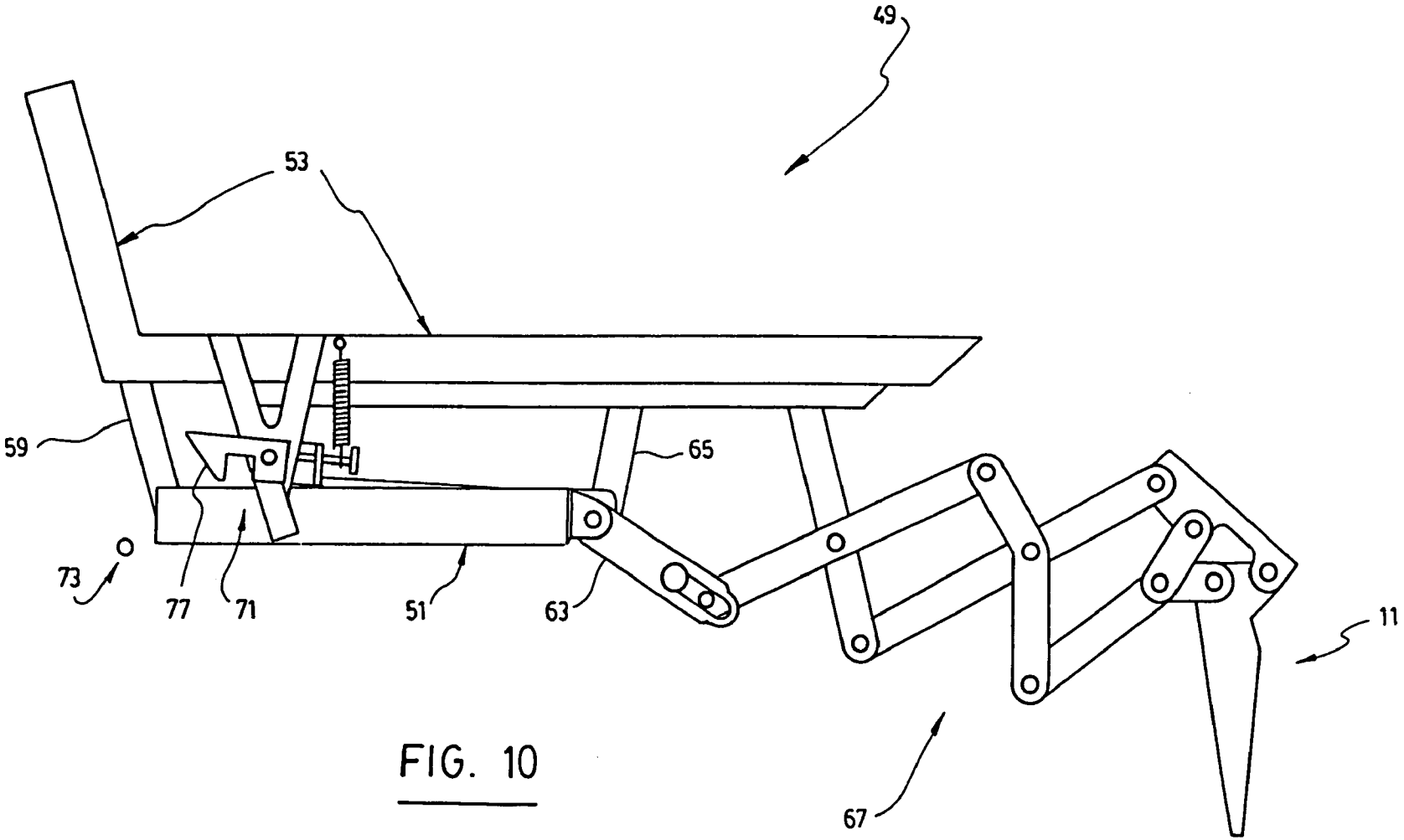
FIG. 10 is another side view of the reverse side of what is shown in FIG. 9.
Figure 11:
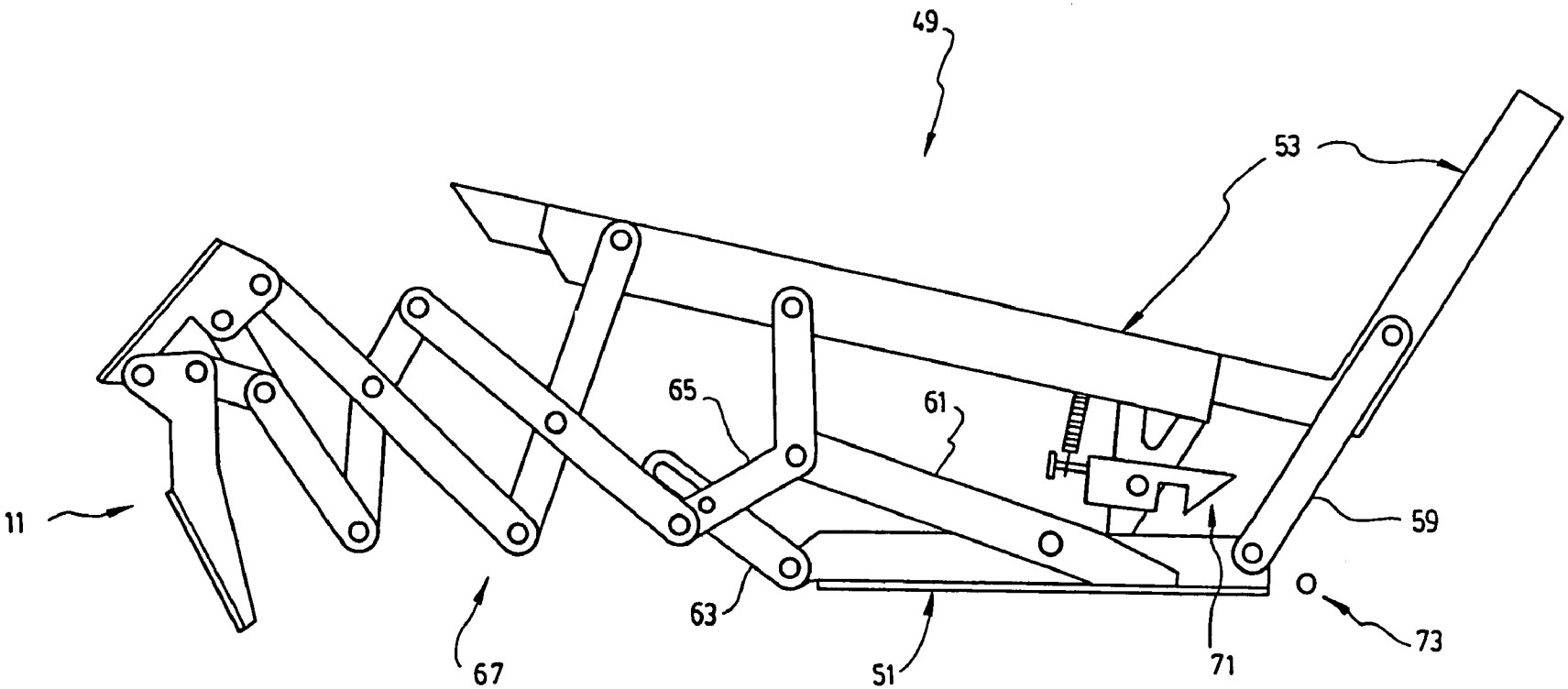
FIG. 11 is another side view of what is shown in FIG. 9, the deployment mechanism being now shown in a first tilted configuration.
Figure 12:
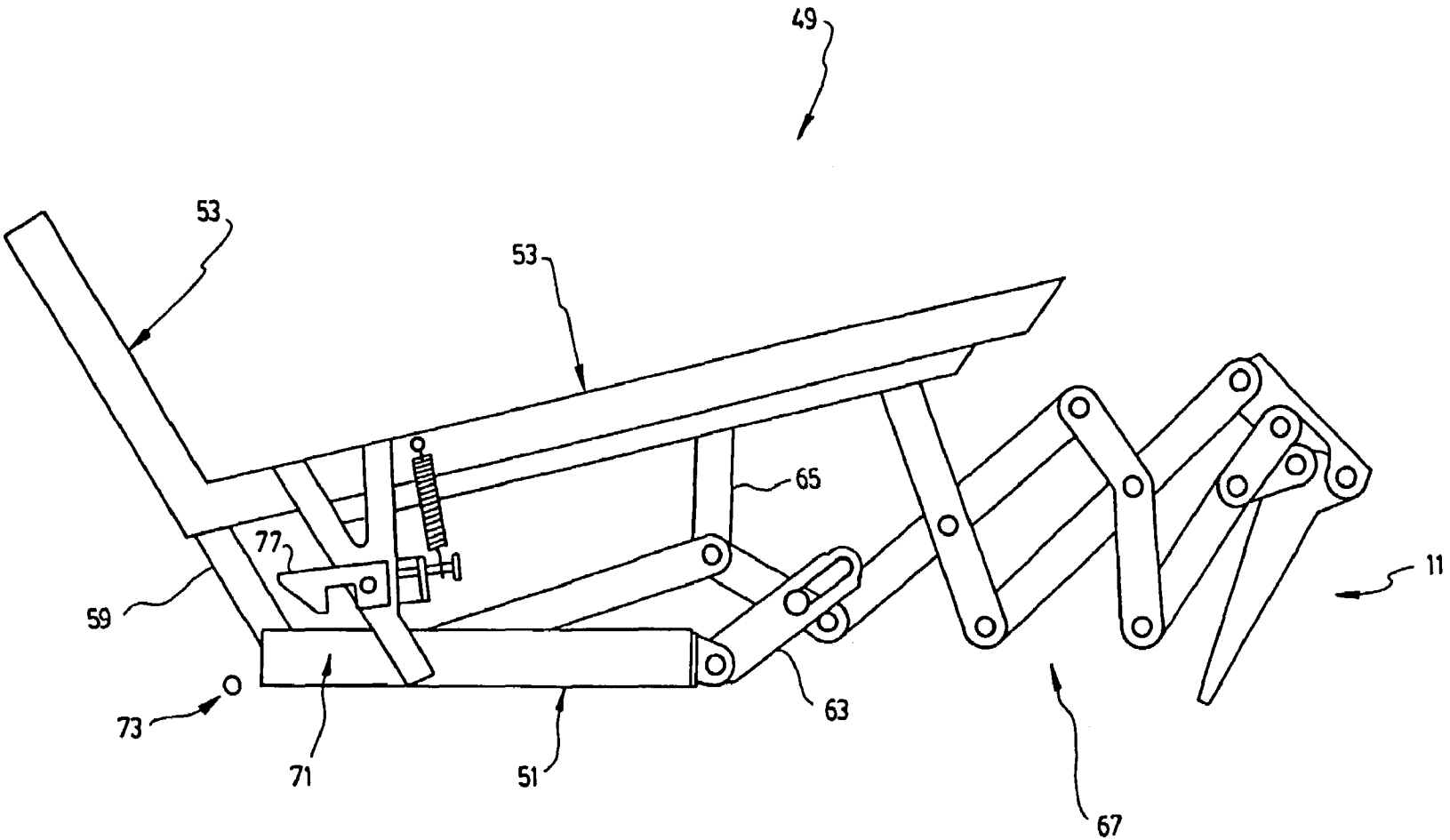
FIG. 12 is another side elevational view of the reverse side of what is shown in FIG. 11.

According to the preferred embodiment of the present invention, and as better shown in FIG. 6, the corresponding links 55 comprise a tilting bar 59, a base bar 61, a rocker bar 63, and a pivot bar 65. The tilting bar 59 preferably has opposite first and second ends 59*a*,59*b*, the first end 59*a* being pivotably mounted about a rear portion of the mounting bracket 51 and the second end 59*b* being pivotably mounted about a rear portion of the support bracket 53 for tilting the support bracket 53 rearwardly with respect to the mounting bracket 51 when the tilting bar 59 is displaced readwardly. The base bar 61 is pivotably mounted about the mounting bracket 51 and has opposite first and second ends 61*a*,61*b*. The rocker bar 63 has first and second ends 63*a*,63*b*, the first end 63*a* being pivotably mounted onto a front portion of the mounting bracket 51, and the second end 63*b* being provided with a slot 63*c*. The pivot bar 65 is preferably substantially V-shaped and has first and second ends 65*a*,65*b*, and a mid end 65*c*, the first end 65*a* being pivotably mounted onto the support bracket 53, the mid end 65*c* being pivotably mounted about the first end 61*a* of the base bar 61, and the second end 65*b* comprising a pin 65*d* being slidably moveable along the slot 63*c* of the second end 63*b* of the rocker bar 63.

The extendable truss mechanism 57 comprises a plurality of intercrossed bars 67, a first bar 67*a* of said intercrossed bars 67 having an end pivotably mounted onto a front portion of the support bracket 53, and a second bar 67*b* of said intercrossed bars 67 having an end pivotably mounted onto the second end 65*b* of the substantially V-shaped pivot bar 65, the bars 59,61,63,65 of the corresponding links 55 and the bars 67 of the extendable truss mechanism 57 being positioned, shaped and sized with respect to one another, and with respect to the mounting and support brackets 51,53 so that a rearwardly displacement of the support bracket 53 with respect to the mounting bracket 51 in turns drives the footrest 11 into the extended position, thereby operating the reclining chair system 1 in the deployed mode, and wherein a further rearwardly displacement of the support bracket 53 with respect to the mounting bracket 51 in turns drives the footrest 11 into the elevated position, as can be easily understood by a person skilled in the art in view of the accompanying drawings, namely FIGS. 2-14.

Preferably also, each deployment mechanism 49 comprises a spring 69 operatively connected between a given bar of the intercrossed bars 67 of the extendable truss mechanism 57 and the support bracket 53, for facilitating a return of the footrest 11 into the retracted position.

Preferably also, the support bracket 53 further comprises a hooking assembly 71 being positioned, shaped and sized for hooking onto a corresponding stopper 73 provided adjacent to a corresponding extremity of the rear horn 37, when the footrest 11 is driven into the elevated position, for preventing the support chassis 9 and corresponding components operatively mounted thereon from being rocked with respect to the intermediate member 5, and thus with respect to the base 3 supporting the same, so as to operate the reclining chair system 1 into a second tilted mode where the reclining chair system 1 is prevented from being operated in the rocking mode.

Preferably also, the hooking assembly comprises a support flange 75 and a hooking member 77. The support flange 75 preferably extends downwardly from the support bracket. The hooking member 77 is pivotably mounted about the support flange 75, and has opposite front and rear ends, the rear end of the hooking member having a slanted portion 79 for slanting past the stopper 73, and a hooking portion 81 frontwardly opposite to said slanting portion 79 for hooking the stopper 73 once the slanting portion 79 has passed over said stopper 73, and the front end of the hooking member 77 being provided with a spring 83 connected to the support bracket 53 for biasing the front end of the hooking member 77 upwardly towards said support bracket 53, as better shown in FIGS. 15 and 16.

Preferably also, the hooking assembly 71 comprises an adjusting device for selectively adjusting a minimum default angle of slant for the hooking member 77. The adjusting device preferably comprises a screw 85 threadedly engaged into a corresponding orifice 87 of a rim 89 of the front end of the hooking member 77 and has an extremity in abutment with an angled portion of the support flange 75, the minimum default angle of slant for the hooking member 77 being selectively adjustable by selectively rotating the screw 85 about the corresponding orifice 87 and against the angled portion of the support flange 75.

It is worth mentioning however, that various different types of adjusting devices other than the above-described could be used for the present reclining chair system 1, as apparent to a person skilled in the art.

Preferably also, the support bracket 53 is substantially L-shaped, the support flange 75 is substantially Y-shaped, and the side frames 7*l*,7*r* are substantially inverted U-shaped. Similarly, it is also worth mentioning that these components, and other components of the present reclining chair system 1 could take on other suitable shapes, configurations and/or interrelations with one another, so as to attain the different features and functions described herein, as apparent to a person skilled in the art.

Preferably also, the side frames 7*l*,7*r* are each provided with corresponding arm rests 91, as better shown in FIGS. 2-5. It is worth mentioning also that the side frames 7*l*,7*r* of the reclining chair system 1 according to the present invention could also be provided with suitable ornamental components, as well as corresponding reinforcement components, such as, for example, transversal bars extending between two substantially vertical portions of each side frame 7*l*,7*r*, as better shown in FIG. 3, and as can be easily understood by a person skilled in the art.

Moreover, it is worth mentioning also that according to the preferred embodiment of the present invention, most exposed outer components of the reclining chair system 1 are upholstered in a suitable manner, as is well known in the art, so as to enable for a more comfortable use of the reclining chair system 1 to a given user, as can also be easily understood also by a person skilled in the art.

According to another aspect of the present invention, there is also provided a method of operating the present reclining chair system 1, as will be explained hereinbelow, and according to yet another aspect of the present invention, there is also provided a kit comprising components for assembling the present reclining chair system 1, as also briefly summarized hereinbelow.

Figure 13:
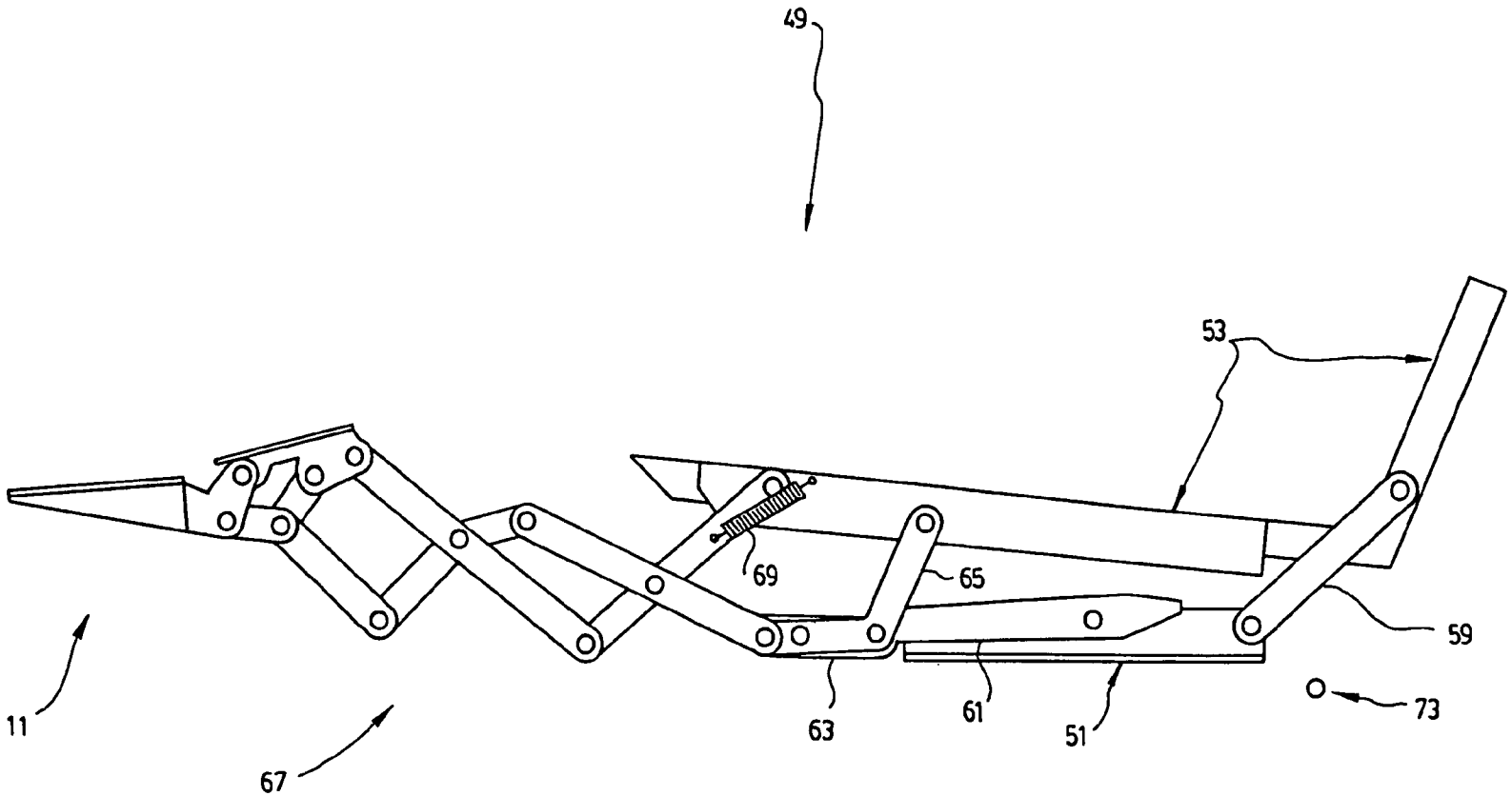
FIG. 13 is another side view of what is shown in FIG. 12, the deployment mechanism being now shown in a second tilted configuration, with the hooking assembly of the deployment mechanism having engaged a corresponding stopper of the system according to a preferred embodiment of the present invention.
Figure 14:
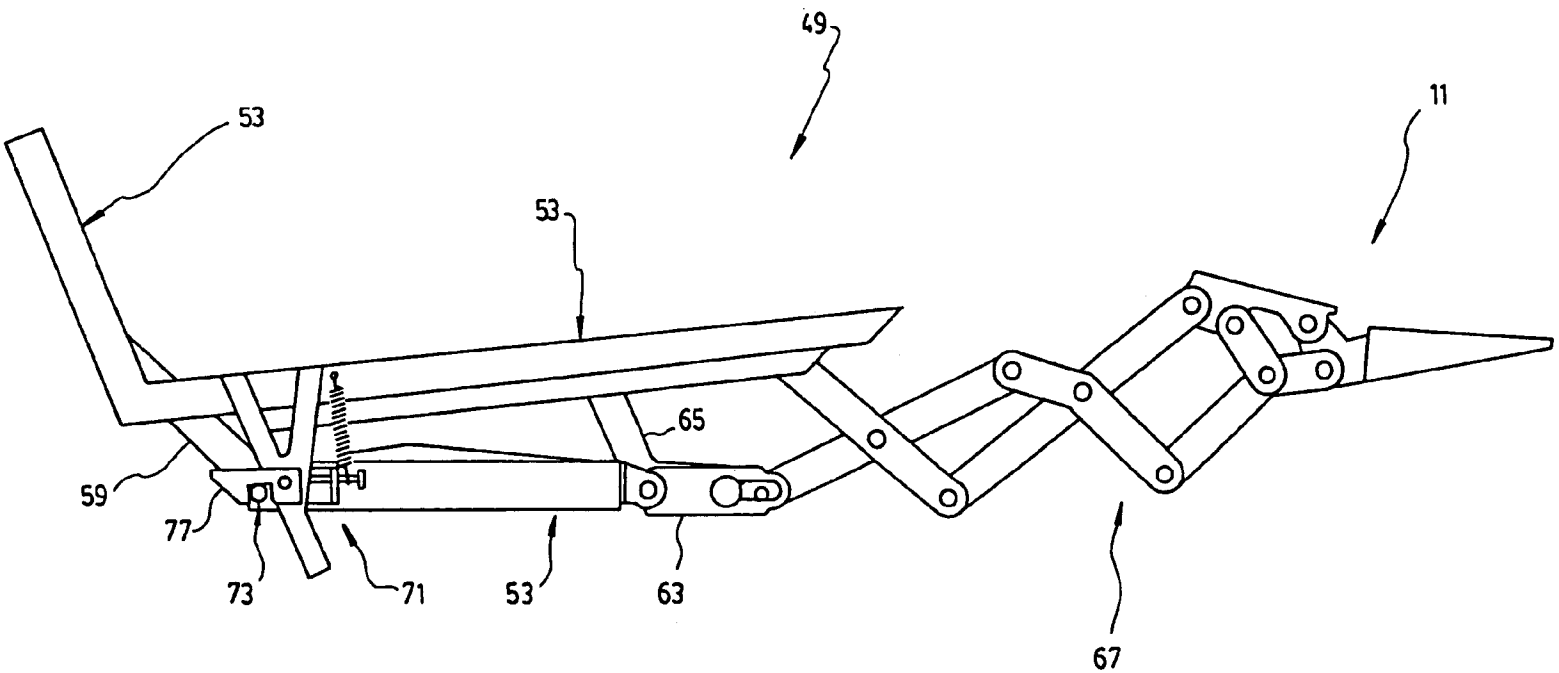
FIG. 14 is another side view of the reverse side of what is shown in FIG. 13, better illustrating the hooking assembly having been hooked onto a corresponding stopper of the system according to a preferred embodiment of the present invention.
Figure 15:
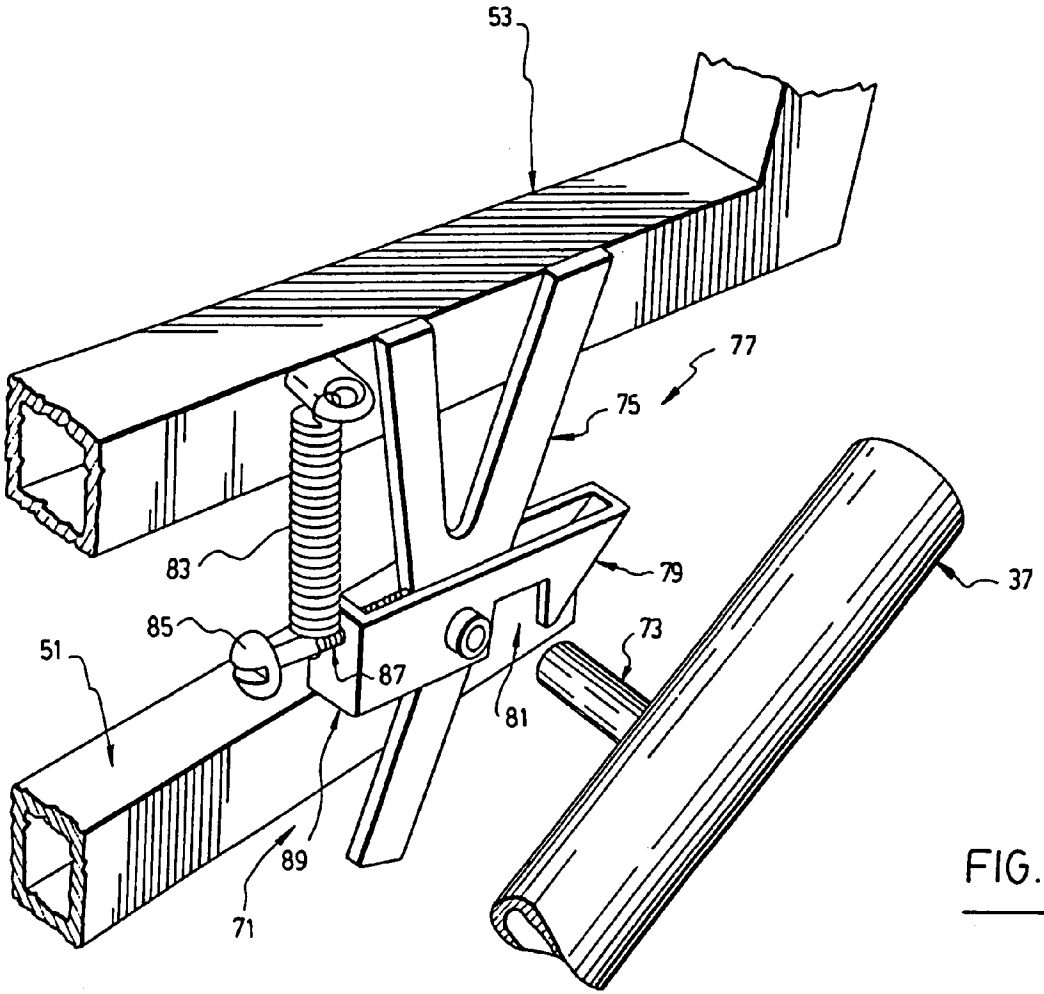
FIG. 15 is a partial enlarged view of a mounting bracket, a support bracket, a support flange, a hooking assembly, an adjusting device and corresponding stopper provided on a rear horn of the system according to a preferred embodiment of the present invention.
Figure 16:
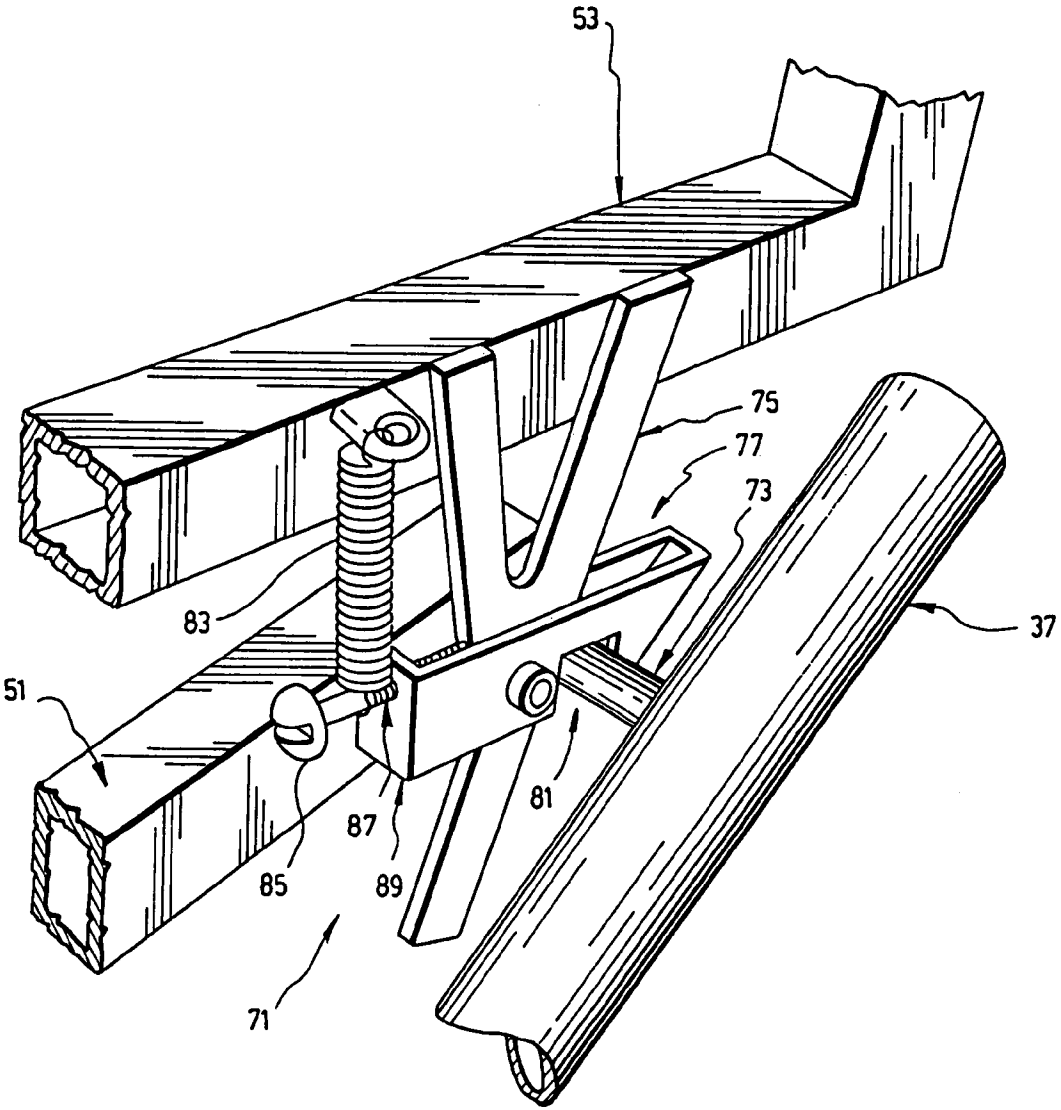
FIG. 16 is another enlarged partial view of what is shown in FIG. 15, the hooking assembly being now shown hooked onto the stopper according to a preferred embodiment of the present invention.

In its preferred intended use, the reclining chair system 1 according to the present invention, as exemplified in the accompanying drawings, is a type of easy chair that rocks, swivels, and reclines the backrest 21, while an extensible support is deployed from underneath the seat to serve as a footrest 11. This easy chair system 1 preferably does not employ any hand lever to recline the backrest 21 or to deploy the extensible footrest 11 or to stop the rocking action. The reclining chair system 1 according to the present invention preferably works as follows:

As can be easily understood by a person skilled in the art in view of the accompanying drawings and the above description, the integrated extensible support is deployed from underneath the seat to support the legs and feet of a given user of the reclining chair system 1. Preferably, to recline the back of the chair and activate the deployment of the extensible footrest 11, one can simultaneously push backwards on the back cushion of the chair while holding onto the armrests of the chair. Preferably, when the recline mechanism and extensible footrest 11 is activated, the gliding action of the chair is automatically halted, while the 360° swivel action is still functional, as previously explained, and as can be easily understood when referring to FIGS. 2-5 and 13-14. The present chair system has preferably different operation modes, positions and configurations. In a first position, the chair rocks and swivels and the extensible footrest is neatly folded up underneath the seat, as better shown in FIGS. 2 and 3. The feet of a user may touch the floor to permit rocking and swiveling. Preferably also, to arrive at a second position, one can push backwards on the back cushion (i.e. backrest 21) while holding preferably onto the armrests as described above, and the seat 19 and backrest 21 will recline while the extensible footrest 11 will deploy to support the legs of a user. In this position, the chair will no longer rock or glide back and forth, but the swivel action is still functional. The third position is preferably obtained in the same way as the second by pushing backward while holding the armrests. The angle of the seat reclines in proportion to the back cushion and the extensible footrest 11 is fully extended and raised, as shown in FIGS. 13 and 14. Again, and preferably also, the chair will swivel but not rock, in that particular configuration.

The reclining chair system 1 according to the present invention presents several features. Indeed, with this type of mechanism, the same features of regular, existing ball bearing gliders, such as the length of the glide, the smoothness of the bearing arms, the height of the chair and the seat, as well as the overall dimensions of length and width are maintained. By adding and modifying an extensible footrest 11 underneath the seat, one can now target two markets, the motion chair category, as well as the recliner category.

The exclusion of a manual lever to perform the various recline positions and to deploy the extensible footrest 11, makes the present system 1 unique and easy to operate, while conserving the features of two products that touch two different markets.

In regards to the assembling of the reclining chair according to the present invention, and in view of the accompanying drawings, it is preferably carried out as follows:

The circular base 3 attaches to the horns 35,37, with the two conical ball bearing casings inserted into the shaft. The chair base 3 is formed by the circular base attached to the horns 35,37. The assembly of these components enables the chair system 1 to swivel 360° degrees.

The two bearing arms 41*f*,41*r* are connected to the horns at the base 3 of the chair and to the side frames 7*l*,7*r* of the chair. The two side frames 7*l*,7*r* of the chair are connected to the chassis 9, via corresponding brackets, and fasteners, as better shown in FIG. 4. This forms the base 3 and sides of the chair.

Starting with the base and sides of the chair, the brackets for the footrest 11 must be fixed to the chassis 9 of the chair. Once assembled, the seat 19 and backrest 21 can be fastened to the support brackets 53 of the extensible footrest 11. This concludes the final step in assembling the finished product.

Additional preferred technical features of the components of the reclining chair system 1 according to the present invention are briefly described hereinbelow.

The circular base 3 supports the chair. The horns 35,37 which the bearing arms 41*f*,41*r* are bolted to are preferably attached to the circular base 3. The height of the base 3 is an important variable to ensure maximum space between the top of the horns 35,37 and the bottom of the seat 19. The ball bearings in the conical casings are preferably inserted into the circular base 3 to allow the horns 35,37 to swivel.

The horns 35,37 preferably support the bearing plates 43, held together by a crossbar 45 and permit the easy chair to swivel 360° degrees when attached to the circular base 3. The angle of these horns 35,37 is important as this will allow the proper clearance underneath the seat 19 while maintaining the appropriate height of the bearing arms 41*f*,41*r* to allow back and forth gliding.

Preferably also, the rocker arms contain ball bearings sealed in a casing. This is what allows the chair to glide back and forth. The distance between the center of each ball bearing casing is what determines the length of the glide, as can be easily understood by a person skilled in the art.

The rocker arms are preferably bolted to and support the sides of the chair. The front bearing arm and the rear bearing arm are also preferably bolted to the horns 35,37.

The chassis 9 supports the left and right mounting brackets 51 of the footrest 11 as well as the left and right side frames 7*l*,7*r* of the chair. Most of the overall weight preferably rests on the chassis 9. The size of the chassis 9 is preferably limited to maintain the backward and forward gliding action. This chassis 9 skims over with out touching the horns 35,37 while gliding. An important aspect resides in creating a solid chassis 9 capable of supporting the overall weight of the chair while the dimensions remained restricted to allow the back and forth gliding action.

The left and the right support brackets 53 must support the seat 19 and the backrest 21 and are fixed to the chassis 9. The movement of the support brackets 53 with respect to the mounting brackets 51 allow the footrest 11 to extend out from underneath the seat. The support brackets 53 are devised to attach to the backrest 21 and seat 19. Another function has been added to stop the rocking action without the use of a manual mechanism. When the recline position is obtained by pushing backward on the backrest 21 while holding onto the arms, a hooking member 77 engages the bearing arms or "stoppers" 73 to stop the rocking action. This is one of the most important functions of the present system 1. Indeed, when weight is transferred in the chair by pushing backwards, the rocking action is halted, when the hooking members 75 are hooked against the corresponding stoppers 73. When weight is transferred in the chair forwards in a given manner, the hooking members 75 become unhooked and the footrest 11 will automatically retract and the chair will once again rock with out any manual devise or mechanism to release the rocking function. The seat 19 and the backrest 21 of the chair are preferably attached to the footrest brackets 53.

Preferably also, the two hooks are attached to the left and right support brackets 53 of the footrest 11. They hook onto the stoppers 73 which are preferably attached to the rear horns 37 and stop the rocking action, as previously explained.

The extensible footrest mechanism is preferably adapted and modified to fit on a swivel, ball bearing gliding recliner functions without any manual mechanism or hand lever. The concept to combine a ball bearing glider and a recliner with integrated extensible footrest according to the present invention must take into account the following considerations: a) the stability of the chair; b) retain the long glide length; c) the balance of the chair, so it does not tip over while gliding or reclining; d) the switch from gliding action to a stopped position without the use of a manual lever; e) the extension of the footrest while reclining the back and seat without the use of a manual lever; and f) installation and modification of the footrest brackets in a restricted space; as apparent to a person skilled in the art.

The different components of the reclining chair according to the present invention preferably interact among each other in the following manner:

The seat 19 and backrest 21 of the chair system 1 are preferably not held in place like a conventional gliding recliner. The seat 19 and backrest 21 are fastened to the support brackets 53. The chassis 9 which supports most of the weight must be appropriately solid to ensure the stability of the chair when it is in gliding mode. The chassis 9 is solidly attached to the side frames 7*l*,7*r* of the chair. The side frames 7*l*,7*r* of the chair are also held into place by the ball bearing arms.

Description of the glide length: the length of the bearing plates 43 and the distance between the ball bearings when attached to the circular base 3 gives the length of the glide.

The equilibrium of the chair with footrest brackets 51,53 installed is determined by the proper placement of said brackets. If it is placed too forward, the chair will tip while gliding. Also, the angle of these brackets 51,53 is important. If the chassis 9 where these brackets are attached is angled too much towards the rear, while reclining the chair, the brackets 51,53 will be too high and the legs will be raised in an uncomfortable position and the horns 35,37 will be hit.

Switching from gliding mode to stopped position without the use of a manual mechanism: when the chair is reclined either at the beginning or end of the rocking motion, the mechanism is deployed to stop the rocking action at a precise point and the footrest 11 is automatically deployed. This precise stopping point is calculated to prevent the chair from tipping backwards when in the recline position. The alterations to the support bracket 53 will allow the stopping action to occur while in any position of the glide length. The hooking assembly 71 attached to the footrest bracket 53 when employed will keep the chair from rocking. This hook mount will fasten and unfasten around the stopper 73 which is attached to support tubes on the base when the inclination of chair is forced backwards or forwards without the use of any manual lever or mechanism.

The extension of the footrest 11 when the seat 19 and backrest 21 are reclined without any manual lever. The seat 19 and backrest 21 are attached to the support brackets 53 of the footrest 11 which is attached to the chassis 9 of the chair. While pushing with the arms to recline the backrest 21, the seat 19 releases the brackets of the footrest 11 allowing it to extend with out the use of a manual lever.

As can also be easily understood from the present invention, the reclining chair and the various components thereof, are preferably made of a suitable material, such as steel and the like, providing suitable structural soundness, while enabling the system to be produced/manufactured/assembled according to a suitable process, and in a cost-effective manner, while being structurally rigid enough to carry out its proper functions, and withstand adverse operating/loading conditions. Other suitable materials may be used according to the present invention, as apparent to a person skilled in the art.

According to the present invention, the reclining chair and corresponding parts may be shaped and sized so as to accommodate different types of people and/or applications. Thus, it could be easily understood that several components and features may be added or modified to the body and corresponding supporting members of the system without departing from the scope of the present invention.

For example, modifications could be made to fit the footrest bracket 53 in a restricted space. Indeed, it can be easily understood that the modifications and alterations to this type of bracket 53 are necessary to ensure the extension of the footrest 11 and the retraction to fit neatly underneath the seat 19. If the bracket 53 is too large, it will knock into other components while the chair is rocking. Other possible modifications and alterations which could be made to the reclining chair system 1 according to the present invention would be to have the horns 35,37 modified as well as the height of the base 3; to alter the framework of the chassis 9; to modify also the brackets 51,53 for the footrest, as well as the hook assemblies 71 on the footrest bracket 53, and modifications could also be made to the attachment of the chassis 9 to the side frames 7*r*,7*l* of the chair.

As may now be better appreciated, the present invention, by virtue of its design and components, as briefly described hereinabove, is a substantial improvement over other related chair systems and/or methods of operating chair systems known in the prior art, namely, but not exclusively, for the different reasons given and explained herein.

Of course, numerous modifications could be made to the above-described embodiments without departing from the scope of the present invention, as defined in the appended claims.

The invention claimed is:

1. A reclining chair system operable about different modes, the reclining chair system comprising:

a base;

an intermediate member comprising opposite left and right sides, the intermediate member being mounted onto the base and being rotatably moveable with respect to the same via a corresponding rotating assembly so as to operate the reclining chair system in a rotating mode;

left and right side frames being operatively mounted respectively onto the left and right sides of the intermediate member via a corresponding rocking assembly so as to operate the reclining chair system in a rocking mode;

a support chassis extending between the left and right side frames for operatively supporting a seat and a backrest of the reclining chair system; and a footrest operatively mounted onto the support chassis and operable therealong between retracted and extended positions via a corresponding deployment assembly so as to operate the reclining chair system in a deployed mode, the footrest being further configured to be operated into an elevated position whereby the deployment assembly of the footrest cooperates with the rocking assembly of the intermediate member so as to prevent the reclining chair system from being operated in the rocking mode;

wherein the intermediate member comprises a pair of front and rear U-shaped members operatively connected to the base and projecting therefrom, the front U-shaped member having extremities defining front connection points and the rear U-shaped member having extremities defining rear connection points, a pair of front and rear connection points being disposed respectively on each of the left and right sides of the intermediate member.

2. A reclining chair system according to claim 1, wherein the rotating assembly comprises a socket provided on the base and a rod provided on the intermediate member, the rod of the intermediate member being insertable into the socket of the base and being rotatable thereabout.

3. A reclining chair system according to claim 2, wherein the base comprises a circular ring for resting against a floor surface, and a plurality of support bars extending between the circular ring and the socket, the socket being elevated with respect to the circular ring.

4. A reclining chair system according to claim 2, wherein the socket of the base is provided with a bearing for receiving the rod of the intermediate member and for facilitating rotation of said rod with respect to the socket of the base.

5. A reclining chair system according to claim 1, wherein each of the left and right side frames comprises front and rear connection points, and wherein the rocking assembly comprises a pair of front and rear bearing arms, the front bearing arms operatively connecting the front connection points of the front U-shaped member of the intermediate member to the front connection points of the side frames, and the rear bearing arms operatively connecting the rear connection points of the rear U-shaped member of the intermediate member to the rear connection points of the side frames, so that the left and right side frames are capable of rocking with respect to the intermediate member, and thus with respect to the base supporting the same.

6. A reclining chair system according to claim 5, wherein the bearing arms each comprise a pair of bearing plates and a crossbar extending between said pair of bearing plates, each bearing plate having opposite ends pivotably mounted onto corresponding connection points of a side frame and U-shaped member respectively.

7. A reclining chair system according to claim 6, wherein the connection points of the U-shaped members and of the side frames are provided with pins for receiving corresponding ends of corresponding bearing plates.

8. A reclining chair system according to claim 7, wherein the deployment assembly comprises a pair of left and right deployment mechanisms, each deployment mechanism comprising:

a mounting bracket securely mounted onto the support chassis extending between the left and right side frames, the mounting bracket being positioned on a given side of the support chassis and said given side being adjacent to a given side frame; and a support bracket for supporting a portion of the seat and backrest being securely mounted onto said support bracket, the support bracket being operatively connected to the mounting bracket by means of corresponding links, and being displaceable rearwardly with respect to said mounting bracket between a leveled position and a first tilted position, so as to operate the reclining chair system into a first tilted mode.

9. A reclining chair system according to claim 8, wherein each deployment mechanism further comprises an extendable truss mechanism having opposite first and second ends, the first end being provided with the footrest, and the second end being operatively connected to the mounting and support brackets, the extendable truss mechanism being further configured for cooperation with the mounting and support brackets so that the footrest be operable between the retracted and extended positions as a result of the support bracket being displaced rearwardly with respect to the mounting bracket, into the first tilted position.

10. A reclining chair system according to claim 9, wherein said corresponding links comprise:

a tilting bar having opposite first and second ends, the first end being pivotably mounted about a rear portion of the mounting bracket and the second end being pivotably mounted about a rear portion of the support bracket for tilting the support bracket rearwardly with respect to the base bracket when the tilting bar is displaced readwardly;

a base bar pivotably mounted about the mounting bracket and having opposites first and second ends;

a rocker bar having first and second ends, the first end being pivotably mounted onto a front portion of the mounting bracket, and the second end being provided with a slot; and a substantially V-shaped pivot bar having first and second ends, and a mid end, the first end being pivotably mounted onto the support bracket, the mid end being pivotably mounted about the first end of the base bar, and the second end comprising a pin being slidably moveable along the slot of the second end of the rocker bar;

wherein the extendable truss mechanism comprises a plurality of intercrossed bars, a first bar of said intercrossed bars having an end pivotably mounted onto a front portion of the support bracket, and a second bar of said intercrossed bars having an end pivotably mounted onto the second end of the substantially V-shaped pivot bar, the bars of the corresponding links and the bars of the extendable truss mechanism being positioned, shaped and sized with respect to one another, and with respect to the mounting and support brackets so that a rearwardly displacement of the support bracket with respect to the mounting bracket in turns drives the footrest into the extended position, thereby operating the reclining chair system in the deployed mode, and wherein a further rearwardly displacement of the support bracket with respect to the mounting bracket in turns drives the footrest into the elevated position.

11. A reclining chair system according to claim 10, wherein each deployment mechanism comprises a spring operatively connected between a given bar of the intercrossed bars of the extendable truss mechanism and the support bracket, for facilitating a return of the footrest into the retracted position.

12. A reclining chair system according to claim 11, wherein the support bracket further comprises a hooking assembly being positioned, shaped and sized for hooking onto a corresponding stopper provided adjacent to a corresponding extremity of the rear U-shaped member, when the footrest is driven into the elevated position, for preventing the support chassis and corresponding components operatively mounted thereon from being rocked with respect to the intermediate member, and thus with respect to the base supporting the same, so as to operate the reclining chair system into a second tilted mode where the reclining chair system is prevented from being operated in the rocking mode.

13. A reclining chair system according to claim 12, wherein the hooking assembly comprises:

a support flange extending downwardly from the support bracket; and a hooking member pivotably mounted about the support flange, and having opposite front and rear ends, the rear end of the hooking member having a slanted portion for slanting past the stopper, and a hooking portion frontwardly opposite to said slanting portion for hooking the stopper once the slanting portion has passed over said stopper, and the front end of the hooking member being provided with a spring connected to the support bracket for biasing the front end of the hooking member upwardly towards said support bracket.

14. A reclining chair system according to claim 13, wherein the hooking assembly comprises an adjusting device for selectively adjusting a minimum default angle of slant for the hooking member.

15. A reclining chair system according to claim 14, wherein the adjusting device comprises a screw threadedly engaged into a corresponding orifice of a rim of the front end of the hooking member and having an extremity in abutment with an angled portion of the support flange, the minimum default angle of slant for the hooking member being selectively adjustable by selectively rotating the screw about the corresponding orifice and against the angled portion of the support flange.

16. A reclining chair system according to claim 15, wherein the support bracket is substantially L-shaped, the support flange is substantially Y-shaped, and the side frames are substantially inverted U-shaped.

17. A reclining chair system according to claim 1, wherein the side frames are each provided with corresponding arm rests.

18. A reclining chair system according to claim 1, wherein exposed outer components thereof are upholstered.

19. A kit for assembling a reclining chair system operable about different modes, the kit comprising:

a base;

an intermediate member comprising opposite left and right sides, the intermediate member being mountable onto the base and being rotatably moveable with respect to the same via a corresponding rotating assembly so as to operate the reclining chair system in a rotating mode;

left and right side frames being operatively mountable respectively onto the left and right sides of the intermediate member via a corresponding rocking assembly so as to operate the reclining chair system in a rocking mode;

a support chassis extendable between the left and right side frames for operatively supporting a seat and a backrest of the reclining chair system; and a footrest operatively mountable onto the support chassis and operable therealong between retracted and extended positions via a corresponding deployment assembly so as to operate the reclining chair system in a deployed mode, the footrest being further configured to be operated into an elevated position whereby the deployment assembly of the footrest is cooperable with the rocking assembly of the intermediate member so as to prevent the reclining chair system from being operated in the rocking mode;

wherein the intermediate member comprises a pair of front and rear U-shaped members operatively connectable to the base for projecting therefrom, the front U-shaped member having extremities defining front connection points and the rear U-shaped member having extremities defining rear connection points, a pair of front and rear connection points being configured to be disposed respectively on each of the left and right sides of the intermediate member.

* * * * *